US010727651B2

(12) United States Patent
Knopf

(10) Patent No.: US 10,727,651 B2
(45) Date of Patent: Jul. 28, 2020

(54) EMISSION TIP ASSEMBLY AND METHOD FOR OPERATING SAME

(71) Applicant: Franz Knopf, Buhl (DE)

(72) Inventor: Franz Knopf, Buhl (DE)

( * ) Notice: Subject to any disclaimer, the term of this patent is extended or adjusted under 35 U.S.C. 154(b) by 402 days.

(21) Appl. No.: 15/533,826

(22) PCT Filed: Jan. 19, 2016

(86) PCT No.: PCT/EP2016/000082

§ 371 (c)(1),
(2) Date: Jun. 7, 2017

(87) PCT Pub. No.: WO2016/116269

PCT Pub. Date: Jul. 28, 2016

(65) Prior Publication Data

US 2017/0338630 A1 Nov. 23, 2017

(30) Foreign Application Priority Data

Jan. 22, 2015 (DE) ..... 10 2015 000 800

(51) Int. Cl.
*H05F 3/04* (2006.01)
*H01T 19/04* (2006.01)
(Continued)

(52) U.S. Cl.
CPC ..... *H01T 19/04* (2013.01); *H01T 19/00* (2013.01); *H01T 23/00* (2013.01); *H05F 3/00* (2013.01);
(Continued)

(58) Field of Classification Search
CPC ..... H01T 19/04; H01T 23/00; H05F 3/04
(Continued)

(56) References Cited

U.S. PATENT DOCUMENTS 1,735,494 A 11/1929 Chapman
1,782,340 A 11/1930 Chapman
(Continued)

FOREIGN PATENT DOCUMENTS

DE 19711342 9/1998
DE 202004014952 3/2006
(Continued)

*Primary Examiner* — Danny Nguyen
(74) *Attorney, Agent, or Firm* — Volpe and Koenig, P.C.

(57) ABSTRACT

The invention relates to an emission tip assembly (100) on high-voltage electrodes for charging or discharging substrates, comprising at least one emission tip (1) and a carrier body (7) comprised of an insulating material, which has at least one high-resistance series resistor (13), wherein the at least one emission tip (1) can be connected to a high-voltage connection (14) by means of the series resistor (13). In order to have available an assembly of emission tips which, despite protrusion from the carrier body (7) thereof to an extent in principle and despite the metal profiled element (10, 10*a*) provided with the insulating potting mass (6), causes no injuries in the event of unintentional and intentional contact and thus permits safe handling together with high efficiency of the assembly, the emission tip (1) is formed of a spring metal and forms an elastic spring element, and a free end of the emission tip (1) is freely spaced apart from the carrier body (7), the particular metal profiled element (10, 10*a*) and the insulating potting mass (6), as a corona tip (2). In addition the range effect of a discharge electrode is improved by the guiding of an auxiliary air quantity (15) directly to the corona tip (2).

18 Claims, 1 Drawing Sheet

(51) Int. Cl.

| | |
|---|---|
| ***H01T 23/00*** | (2006.01) |
| ***H01T 19/00*** | (2006.01) |
| *H05F 3/06* | (2006.01) |
| *H05F 3/02* | (2006.01) |
| *H05F 3/00* | (2006.01) |

(52) U.S. Cl.
CPC ..... *H05F 3/02* (2013.01); *H05F 3/04* (2013.01); *H05F 3/06* (2013.01)

(58) Field of Classification Search
USPC ..... 361/230, 213, 220, 231
See application file for complete search history.

(56) References Cited

U.S. PATENT DOCUMENTS

| | | | | | |
|---|---|---|---|---|---|
| 5,369,427 | A * | 11/1994 | Itaya | B41J 2/39 | 347/125 |
| 5,592,357 | A * | 1/1997 | Rader | B01D 39/083 | 361/225 |
| 5,930,105 | A * | 7/1999 | Pitel | H05F 3/04 | 361/212 |
| 6,504,700 | B1 | 1/2003 | Hahne et al. | | |
| 2018/0191139 | A1* | 7/2018 | Domschat | H01T 19/04 | |

FOREIGN PATENT DOCUMENTS

| | | | | |
|---|---|---|---|---|
| DE | 102011007138 | | 6/2012 | |
| DE | 102011007136 | | 10/2012 | |
| EP | 0871267 | | 10/1998 | |
| EP | 1241755 | | 9/2002 | |
| JP | 2014229349 | * | 5/2013 | C10J 3/54 |

* cited by examiner

EMISSION TIP ASSEMBLY AND METHOD FOR OPERATING SAME

BACKGROUND

The invention relates to an emission tip assembly on high-voltage electrodes for charging or discharging substrates, comprising at least one emission tip, and comprising a carrier body which is composed of an insulating material and has at least one high-resistance series resistor and is arranged on a metal profile which is provided with an insulating potting compound, wherein the at least one emission tip can be connected to a high-voltage connection by means of the series resistor. In this case, the metal profile can be connected to ground and provided with an insulating layer, and the series resistor can be arranged on the metal profile in an electrically insulated manner. The invention also relates to a method for operating an assembly of this kind in AC voltage at a specific peak voltage, and also to a method for operating an emission tip assembly with auxiliary air supply.

A large number of embodiments and variants of passive and active discharge electrodes or active charging electrodes are known. Electrodes of this kind often have a plurality of emission tips which are arranged with various grid widths in a single row, in two rows or else as a planar emission tip array in such a way that they resemble, for example, a bed of nails. Emission tips of this kind are very frequently embedded together with a current-limiting resistor in elongate U-profiles by means of insulating casting resin. The electrical resistor is associated either with each individual tip or else n tips. Passively acting discharge electrodes are often also used without current-limiting resistors in practice.

If there is an electric field, the highest possible electric field strength should be active at the tips for an assembly of emission tips of active and passive high-voltage electrodes. In addition to maintaining further boundary conditions, the respective tip has to protrude to a sufficient extent out of the insulating embedding for this purpose. This is entirely compatible with the necessarily freestanding end of a lightning conductor above the object which is to be protected.

However, for a good reason, even this condition of the freestanding tip is secondary to operating safety when electrodes of this kind are used in practice. Specifically, in order to minimize the risk of injury to machine operators by way of electrodes of this kind with emission tips, the usually rigid and solid emission tips barely protrude out of the insulating potting compound of the electrode profile. The two limbs of the usually U-shaped profile cross section are often constructed in such a way that they are level with the tips, so that the risk of injury remains minimal even in the event of unintentional lateral contact with the electrode body.

One disadvantage of this is that this physical proximity of the emission tip to the surface of the profile body under usual operating conditions considerably reduces the electric field strength at the tip since large field ranges of the electric field with a shortening free tip end increasingly pass through the insulating body to the conductive, cast conductors of the inner electrode structure and therefore do not end, as intended, at the freestanding tip in order to generate the highest possible Field strength there.

If discharge electrodes are operated in a passive manner, this is accompanied, for example, by a significant increase in the corona inception with respect to the surface potential which is to be discharged. In this case, the term corona inception describes that voltage at which free charge carriers, that is to say electrons and ions of both polarities which ultimately cause the passive discharge, are generated in front of the tips by impact ionization; the gas between the tips and the charged object surface becomes conductive. In other words, in the case of non-optimum corona inception conditions of this kind, the object surface which is to be passively discharged remains at a relatively high potential, or: the less the emission tip protrudes out of the potting compound, the lower the passive discharge capacity of the electrode.

Analogously, it is the case for actively operated discharge electrodes that, given short tips, under the explained geometric conditions, for the intended active discharging effect, the AC operating voltage of the electrode which is required for generating a sufficiently large number of air or gas ions has to be increased, as a result of which the degree of efficiency of the active discharge capacity decreases.

In this case, high operating voltages in the kilovolt range are accompanied by further disadvantages for the operation of electrodes of this kind, specifically reduced operating reliability, the disruptive proximity of machine parts which are connected to ground and, last but not least, the relatively high production costs, both of the electrode and also of the high-voltage supply unit.

For positively or negatively operated DC charging electrodes, a non-freestanding tip has the disadvantage that the charging current required for the application can flow only at relatively high operating voltage. The resulting disadvantages are comparable with those of the active discharging electrode. For the sake of completeness, it should be mentioned that this obviously also applies for special, bipolar-operated DC discharge electrodes.

DE 197 11 342 A1 discloses, for example, an active electrode which is operated with a high AC voltage, the construction of said electrode corresponding to that above. The rigid emission tips of the assembly in said document protrude only minimally out of the insulating casting resin and the two limbs of the U-shaped profile end approximately level with the tips.

Furthermore, DE 10 2011 007 138 A1 discloses a design of special high-voltage polymer resistors in connection with rigid emission tips which are used as semi-finished products when producing high-voltage electrodes.

EP 1 241 755 A2 discloses, in contrast, an active discharge electrode with air assistance. This contains even emission tips which are situated lower than the insulating surroundings of the air guide or air nozzle.

Comparably unfavorable conditions can also be found with conventional commercially available charging electrodes with and without air assistance, as are known from DE 20 2004 014 952 U1 for example.

SUMMARY

The object is therefore to provide an assembly of emission tips which avoids the abovementioned features and, in spite of protruding to any desired extent out of their carrier body in principle, does not cause any injuries if unintentionally or intentionally touched, and in this way allows safe handling together with a high degree of efficiency of the assembly.

This object is achieved by an emission tip assembly of the kind outlined in the introductory part, in which the emission tip is formed from a spring metal and forms an elastic spring element, and a free end of the emission tip, in the form of a corona tip, extends freely at a distance from the carrier body. In this case, the spring element can be designed, for example, in a helical spring-like manner. However, this is not an absolutely necessary prerequisite; other spring designs are also feasible.

The emission tip or tips of the emission tip assembly according to the invention are therefore formed from a metal spring material as spring tips and are provided, for example in a helical spring-like manner, in such a way that they can protrude beyond the electrode body to any desired extent. Therefore, the emission tip or tips can be configured as metal springs, that is to say, for example, as a spring element which is formed from a metal.

As a result, said emission tips, that is to say the emission tips which are in the form of spring tips, do not cause any appreciable mechanical resistance, which would be suitable for causing injuries, if they are unintentionally or intentionally touched. This satisfies the precondition of being able to utilize the functional advantages of spring tips of this kind as emission tips for discharge and charging electrodes in the best possible manner.

In line with the associated physical law and also as can be demonstrated by experiments, the freestanding spring tip here has a considerably lower level, specifically a level reduced by up to 30%, for the corona inception and therefore improves the effect of passively operating discharge electrodes even with the simplest electrode design for one or else a number of n spring tips. This positive effect of the low corona inception therefore increases the degree of efficiency even for actively operating AC discharge electrodes when generating additional bipolar ions with freestanding corona tips of this kind. Depending on the intended use, it is important, given a comparable discharge capacity, for the AC discharge electrode with a freestanding spring tip to manage with a relatively low high AC operating voltage. This is of high importance particularly in a narrow machine environment which is connected to ground.

The transmission of this effect to DC charging electrodes means that the desired electric current or the electric current which is required for the charging application can likewise flow even in the case of a relatively low, but in this case of course, high DC operating voltage.

Accordingly, in advantageous embodiments of the emission tip assembly, the high-voltage electrode or electrodes can be operated or is/are operated in an active or passive manner as a charging and/or discharge electrode by AC or DC voltage.

In terms of wear of the emission tip during use, an embodiment of the emission tip assembly in which an end section of the free end of the emission tip, which acts as a corona tip for example, is bent in the direction of the longitudinal axis of the direction of extent of the spring element is advantageous. A last, relatively short piece of the emission spring tip of this kind, which piece is angled in the direction of the center of the helical spring, wears away, for example by means of the corona current, over the service life of the electrode under virtually constant geometric conditions. In contrast to a conventional tip, of which the truncated cone would wear away by means of the corona current to form an increasingly large diameter, the emission spring tip according to the invention has constant geometric conditions and therefore the desired constantly low corona inception threshold over the service life of the corona tip.

An embodiment of the emission tip assembly in which the freestanding emission spring tip can also operate with air assistance as required, for which reason the interior of the helical spring element forms a passage which can be connected to a channel of the carrier body and by means of which an auxiliary air quantity can be supplied to the emission tip, is further advantageous. To this end, the freestanding emission spring tip outside the electrode body can be connected to the carrier body, which is embedded in an insulating potting compound for example, in such a way that, in the interior of the carrier body which is composed of insulating material, the air channel adjoins the inside diameter of the emission spring tip in a suitable manner so as to transmit air and therefore the auxiliary air quantity can reach each individual emission spring tip by means of an air distributor channel.

The emission spring tip according to the invention is accordingly designed such that the degree of ionization of the auxiliary air quantity used in AC discharge electrodes can be considerably increased in comparison with the known active discharge electrodes with air assistance. The latter is synonymous with a considerable cost saving when generating the compressed air quantity which is required for operation. In addition to the high costs, non-ionized large auxiliary air quantities are undesired and even disruptive in many processes.

The increase in the degree of ionization of the auxiliary air quantity is primarily due to the formation of the corona tip at the free end of the emission spring tip which, as a thin conductive wire end, is arranged freely above the center of the air-carrying spring tip. This means that, here, a corona tip can be understood to mean the thin conductive end of the wire which is arranged freely above the center of the, possibly air-carrying, spring tip. In a further embodiment of the emission tip assembly, the spring element, for example the inner contour of the spring element which acts as a boundary for the supplied auxiliary air quantity within the spring element, can expediently taper in the direction of the free end of the emission tip. The last turns of the helical spring-like spring tip then run, for example, conically, this leading to a nozzle-like air outlet. The auxiliary air which is therefore directed in a targeted manner onto the corona tip assists the ion wind, which is generated by the corona tip, and is therefore ionized in the best possible manner for its part, this ultimately accounting for the high degree of efficiency or degree of ionization and the range effect of the provided ionized auxiliary air quantity.

In advantageous developments of the emission tip assembly with expedient insulation of the respective carrier body, said carrier body can be formed from a thermoplastic or thermoset material or a ceramic material.

In a preferred development of the emission tip assembly, which allows in particular a simple and easy-to-handle assembly of a large number of emission spring tips, the carrier body can be provided with at least one receptacle, which is located on a side wall, for arranging at least one emission tip, it being possible to press the emission tip into said receptacle. In another development, the contour of the emission tip can advantageously be elastically deformable for this purpose when said emission tip is arranged on the carrier body, wherein contour at this point means that the structure which forms the shape of the emission tip is elastically deformable, so that the emission tip can be pressed into the receptacle for example.

In one embodiment of the emission tip assembly according to the invention, a secure conductive connection between the resistor and the respective emission tip can be established by the at least one series resistor being mounted on the carrier body in a meandering manner and/or making contact with the spring element in the region of the receptacle by means of a conductive adhesive. Other designs of the series resistor are also feasible at this point.

In another refinement of the emission tip assembly according to the invention, the assembly is held, by way of the carrier body, by a metal profile which is connected to ground, and the series resistor is arranged on the metal profile in an electrically insulated manner, as a result of which the advantages of the technology of metal profiles can be utilized. On account of the ease of handleability, the metal profile is in this case preferably manufactured from an extrudable material, in particular from an aluminum material, and the insulation of the series resistor from the metal profile can be achieved as far as possible by an insulating potting compound.

For safety reasons, said metal profiles are always electrically connected to ground, which would mean that the majority of the generated electrons and bipolar ions would flow away to ground potential, for which reason an expedient development of the invention involves providing said metal profile with a thin insulation layer which is both mechanically and electrically resistant to a sufficient extent. If the volume resistance of this insulation layer is selected to be $>10^9$ Ωm, no ohmic electric current which is relevant for electrode function flows to ground potential across this resistor given a sufficiently high electrical breakdown voltage.

A further advantageous embodiment of the emission tip assembly according to the invention can be provided with a carrier body which has a capacitance, which can be manipulated when said carrier body is produced, in relation to the metal profile such that the capacitive reactive current of the high-voltage electrode at least partially compensates for the inductive reactive current of the high-voltage transformer which is used during operation of an active discharge electrode.

As the quality of the electrical insulation increases, the design-related quality of the capacitance (small loss angle tan δ) of the metal profile also increases, both in relation to the cast carrier body and also in relation to the freestanding corona tip. This is desirable inasmuch as high-voltage transformers, which constitute inductive components, are used for operating active AC discharge electrodes. The inductive reactive current which is required for operating the transformer is, in the present case, with suitable dimensioning of the metal profile, advantageously largely compensated for by the capacitive reactive current of the capacitance of the entire electrode structure. In accordance with the laws of alternating current teachings, this means that metal profiles which are modified in this way require smaller transformer constructions for operating the AC electrodes, which transformer constructions form a unit with the electrode as required. The latter then advantageously avoids laying of high-voltage cables between transformer and electrode. The primary-side AC supply voltage of the transformer can be either the customary supply system voltage or the 24 VAC control voltage of electrical installations. In addition to these cost-effective solutions, it is also possible to supply electrical energy to the transformer with a 24 VDC control voltage; however, in this case, the required AC voltage for the transformer has to be generated by means of a semiconductor circuit.

The object is also achieved by a method for operating an assembly of emission tips, comprising at least one emission tip, in particular an assembly as described above, which is distinguished in that the high-voltage electrode is operated in AC voltage with a peak voltage which is lower than the breakdown voltage for the used geometry of the corona tip to the metal profile which is connected to ground and is provided with an insulating layer. The capacitive coupling of the corona tip of the AC discharge electrode to ground potential is advantageously utilized in this case. The capacitive coupling between the corona tip and the metal profile which is electrically insulated at the surface but is connected to ground in the interior additionally improves the ion generation of active AC electrodes, this amounting to an additional significant increase in the degree of efficiency. In this case, the distance of the corona tip from the insulating layer has to be selected such that the peak voltage of the high AC operating voltage is less than the breakdown voltage for the geometry of the corona tip to the metal profile, which is connected to ground, comprising the insulating layer. No further ground conductors, which are embedded in an insulating manner, are required here either.

Moreover, the object is achieved by a method for operating an assembly of emission tips, comprising at least one emission tip, which is distinguished in that the emission tip is in the form of a spring element, and a passage is formed, an auxiliary air quantity being supplied to the corona tip through said passage during operation, since the degree of ionization of the auxiliary air quantity used in AC discharge electrodes can be considerably increased in comparison to known active discharge electrodes with air assistance. In this case, the auxiliary air which is directed onto the corona tip in a targeted manner assists the ion wind, which is generated by the corona tip, and is therefore ionized in the best possible manner for its part, this ultimately accounting for the high degree of efficiency or degree of ionization and the range effect of the provided ionized auxiliary air quantity. It can preferably be provided that the emission tip forms a passage, in particular the passage mentioned above, through which an auxiliary air quantity is supplied or can be supplied to the corona tip during operation.

The above assembly of emission tips accordingly has a series of advantages which can be summarized roughly as follows.

By reducing the corona inception threshold, an increased passive discharge effect is achieved. This is synonymous with electrical discharge of charged surfaces down to correspondingly relatively low electrical residual surface potentials. The reduction in the corona inception threshold of the freestanding tip also increases the degree of efficiency for active AC discharge electrodes when additionally generating bipolar ions and electrons. The level of the high operating voltage required analogously reduces given a comparable discharge capacity.

The series connection of each freestanding spring tip with a high-resistance resistor of the order of magnitude of $10^8$Ω, wherein all of the resistors are individually connected to the common high-voltage connection, allows the use of spring tips of this kind both for passively operated discharge electrodes and also for actively operated discharge electrodes, and also for DC charging electrodes in areas which are at risk of explosion. In addition, DC charging electrodes comprising an assembly of such freestanding emission spring tips likewise require a relatively low high operating voltage for generating the charging current required for the respective application.

In respect of assistance by means of an auxiliary air stream, the advantage achieved is that of more efficient ionization of the auxiliary air quantity in order to increase the range of the discharge effect of active discharge electrodes for medium and large ranges. The auxiliary air can also be used merely for continuously or intermittently keeping the corona tip clean in an efficient manner in dirty environments. This is important both for discharge and for charging electrodes. Charging electrodes, as are used, for example, in so-called "top loading" ESA systems in printers, are provided with a significantly longer service interval as a result.

Active discharging with air assistance and at the same time reduced high AC operating voltage allows efficient use even in a relatively narrow machine environment which is connected to ground, such as in packaging processes in the pharmaceutical industry etc. for example. A large range of the discharge effect and the close machine environment which is connected to ground are then no longer contradictory here.

With respect to the design of the end section of the emission spring tip, the design-related advantage achieved is that the last, relatively short piece of the spring tip which is angled in the direction of the center of the helical spring wears away over the service life of the electrode under virtually constant geometric conditions. In contrast to a conventional tip, of which the truncated cone wore away by means of the corona current to form an increasingly large diameter, the emission spring tip according to the invention has constant geometric conditions and therefore the desired constantly low corona inception threshold over the service life of the corona tip.

Finally, mechanical contact protection is necessarily provided for spring tips of any desired length, which extend freely beyond the electrode body, owing to the elasticity and the associated flexibility of the spring tip.

BRIEF DESCRIPTION OF THE DRAWINGS

The invention will be explained in more detail below with reference to exemplary embodiments in the drawing. In the drawing, in a partially schematic illustration.

DETAILED DESCRIPTION OF THE PREFERRED EMBODIMENTS

Figure 1:
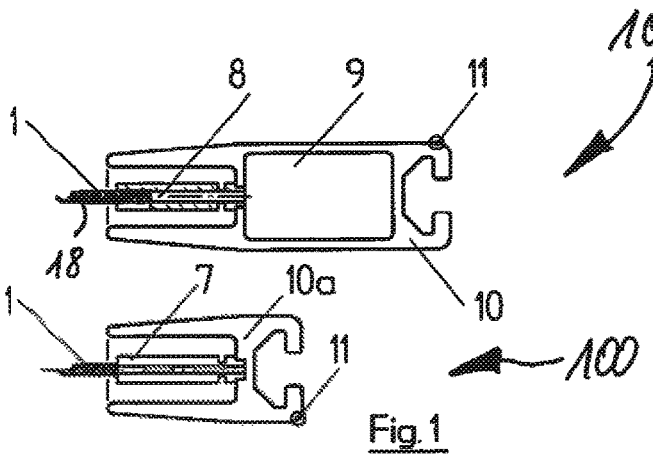
FIG. 1 shows a sectional side view of two alternative electrode designs comprising the components which are required for functioning, once without possible air assistance with a metal profile (bottom) and once with a metal profile and an integrated air distributor channel for optional air assistance (top)

FIG. 1 shows two emission tip assemblies, which are denoted 100 overall, in each of which an emission tip 1 which is in the form of a helical spring-like spring element is shown. The associated emission tip assembly 100 in each case has a carrier body 7 which is composed of an insulating material and has high-resistance series resistors 13, shown only in FIG. 2, for the emission tips 1, wherein the at least one emission tip 1 can be connected to a high-voltage connection 14 by means of the series resistor 13 in each case.

In the illustrations of FIG. 1, the emission tips 1 are each held, by way of the associated carrier body 7, in a metal profile 10, 10*a*. In the top view, the metal profile 10 has an air distributor channel 9 which continues into the air channel 8 of the carrier body 7, so that an auxiliary air quantity 15 (shown only in FIG. 3) can be supplied to the emission tip 1 by means of connected compressed air. The bottom view of FIG. 1 comprising the metal profile 10*a* does not exhibit the corresponding air distributor channel.

Figure 2:
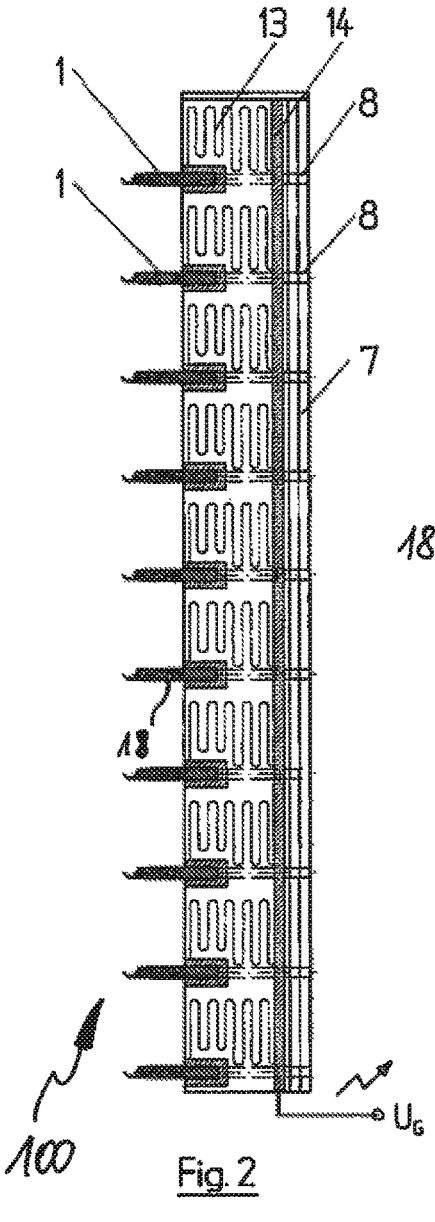
FIG. 2 shows a sectioned side view (on the right-hand side) and a plan view (on the left-hand side) of a support body comprising a plurality of incorporated emission spring tips and mounted resistors and separate air channels for each spring tip for illustrating the receptacles for the emission spring tips.
Figure 3:
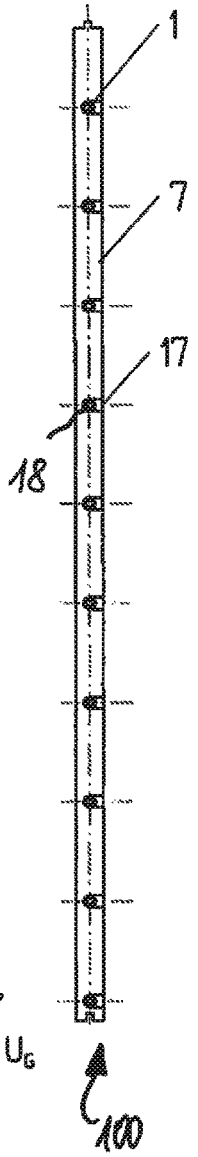
FIG. 3 shows a sectioned side view of the emission tip assembly according to the invention comprising an air distributor channel from the top view of FIG. 1 in greater detail.
Figure 3:
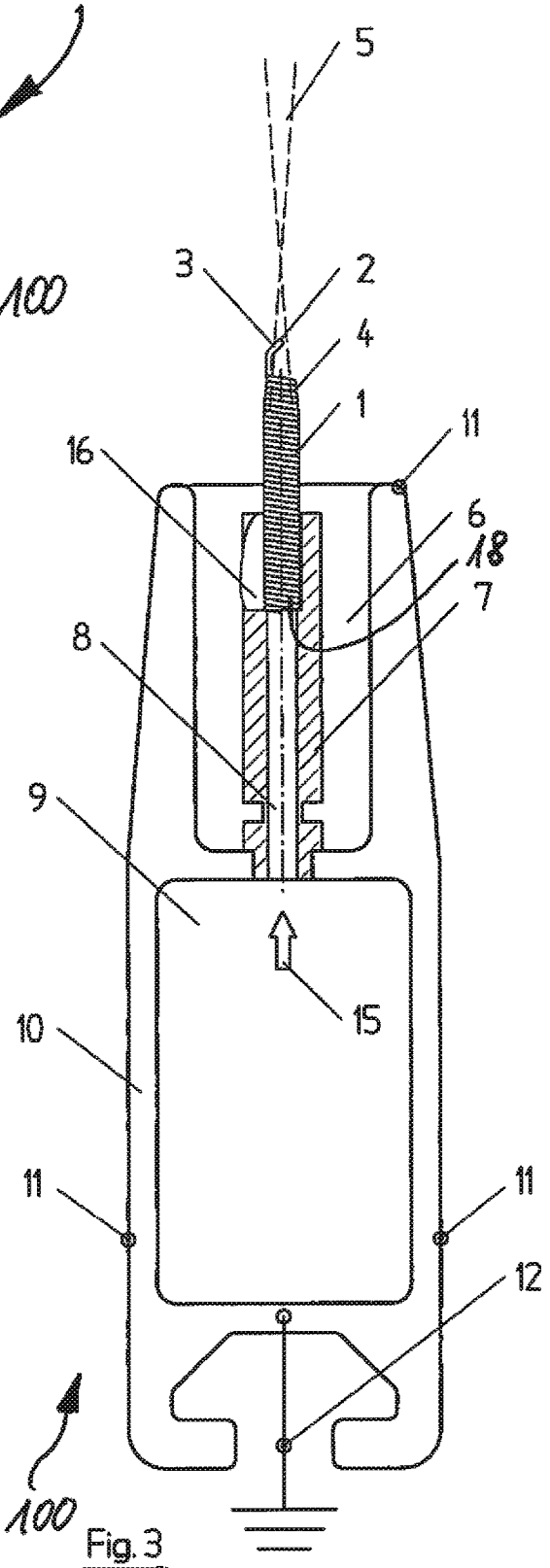

The emission tips for electrical discharge or charging electrodes of FIGS. 1 to 3 are operated with a high AC or DC voltage $U_g$, the series resistor 13 is electrically insulated from the metal profile, for example, by a potting compound 6 (cf. FIG. 3) and arranged at, that is to say for example in particular on, the carrier body 7 which is embedded in a metal profile 10 which is connected to ground. The emission tip 1 is formed from spring metal and has a helical spring-like shape. The free end of the emission tip 1, in the form of corona tip 2, extends freely above the carrier body 7 and/or above the respective metal profile 10, 10*a* and/or freely above the associated insulating potting compound 6 (cf. FIG. 3), wherein that end section 3 of the emission tip 1 which is averted from the carrier body is bent in the direction of the longitudinal axis of the direction of extent of said emission tip. Therefore, the end section 3 wears away starting from the corona tip 2 under virtually constant geometric conditions during operation of the electrode, it being possible to equate this with virtually constant emission conditions for the corona current of the corona tip 2.

FIGS. 2, 3 and the top illustration in FIG. 1 show that the inside diameter of the emission tip 1 is connected to an air channel 8 in the interior of the carrier body 7. In this case, the turns of the spring element of the emission tip 1 form a passage 18 in such a way that the auxiliary air quantity 15 reaches each individual emission tip 1 and corona tip 2 in order to improve the ion range over the air distributor channel 9. The increase in the degree of ionization of the auxiliary air quantity 15 takes place by means of the geometric positioning of the corona tip 2 above the center of the emission tip 1 in this case. Moreover, the increase in the degree of ionization of the auxiliary air quantity 15 is caused by means of the conically decreasing diameter of the last turns 4 of the air outlet 5, which acts in a nozzle-like manner, of the emission tip 1; the auxiliary air quantity 15 can, together with the air outlet 5 which acts in a nozzle-like manner, also serve only to clean the corona tip 2 or keep said corona tip clean as required.

The emission tips 1, shown in FIGS. 1 to 3, of the emission tip assembly 100 can protrude to any desired extent beyond the potting compound 6 of the metal profile 10 in order to achieve the highest possible field strength at the corona tip 2, and despite this there is no risk of injury since the emission tips are in the form of spring elements and are elastically flexible. FIGS. 1 to 3 also show that the metal profiles 10, 10*a* which are connected to ground potential 12 are provided with an insulating layer 11, so that the emission tips 1 which are connected to high AC voltage can more than double the bipolar ion production in comparison to conventional electrodes by means of the adapted capacitive coupling of the corona tip 2 to the respective metal profile 10 or 10*a*.

The carrier body 7 shown in FIGS. 1 to 3 is produced from an insulating plastic. In this respect, FIG. 2 shows that the carrier body 7 is provided in such a way here that the emission tips 1 can each be pressed with an accurate fit and without a soldering process into receptacles 17 of the carrier body 7, which receptacles are open to one side, by the diameter of the emission tips 1 being elastically deformed.

FIG. 2 furthermore shows that the series resistor 13 is arranged on the carrier body 7 in a meandering manner and makes contact with the metal emission tip 1 in the region of the receptacle 17, which is open to one side, by means of a conductive adhesive 16. The design-related capacitance of the support body 7 to the metal profile 10 is dimensioned such that the capacitive reactive current which increases as the electrode length increases largely compensates for the inductive reactive current of a high AC voltage transformer, not illustrated any further, in order to operate the active discharge electrode, this allowing very small transformers which, together with the metal profile 10, can form a unit (not shown). Looking once again at FIG. 3, said figure shows the sectional view of a strand-like metal profile 10 which, continued in the viewing plane, is provided with an insulating layer 11 and is of U-shaped design at its end which is at the top as seen by the viewer. A resistance body 7, for example said carrier body 7, comprising air channel 8 is held between the limbs of the U-shaped profiling, an emission tip 1 being arranged at that end of said resistance body which is averted from the metal profile 10. The emission tip 1 is formed in a helical manner as a spring element from a spring metal, the free end of said emission tip tapering upward as seen by the viewer by way of its last turns 4, and the end section 3 of its free end forms a corona tip 2 which is bent in the direction of the longitudinal center axis of the emission tip. That end of the emission tip 1 which is at the bottom as seen by the viewer is connected by way of its cross section to the air channel 8, so that an auxiliary air quantity 15 can be supplied from the air distributor channel 9 to the cross section which leads to the air outlet 5 at the corona tip 2. The metal profile 10 has a ground connection 12 at its end which is averted from the emission tip.

Accordingly, the invention described above relates to an emission tip assembly 100 on high-voltage electrodes for charging or discharging substrates, comprising at least one emission tip 1, and comprising a carrier body 7 which is composed of an insulating material and has at least one high-resistance series resistor 13, wherein the at least one emission tip 1 can be connected to a high-voltage connection 14 by means of the series resistor 13. In order to have an assembly of emission tips available, which assembly does not cause any injuries when unintentionally or intentionally touched in spite of protruding to any desired extent out of its carrier body 7 in principle and in this way allows safe handling with a high degree of efficiency of the assembly, the emission tip 1 is formed from a spring metal and forms an elastic spring element, and a free end of the emission tip 1, in the form of a corona tip 2, extends freely at a distance both from the carrier body 7 and from the respective metal profile 10, 10*a* and the associated insulating potting compound 6.

The invention claimed is:

1. An emission tip assembly (100) with high-voltage electrodes for charging or discharging substrates, comprising at least one emission tip (1) adapted for connection to a high AC voltage, a carrier body (7)

formed of an insulating material, having at least one high-resistance series resistor (13), and arranged on a metal profile (10, 10*a*) which is grounded, covered with an insulating layer (11), and provided with an insulating potting compound (6), the at least one emission tip (1) is connectable to a high-voltage connection (14) by the series resistor (13), the assembly (100) is held, by way of the carrier body (7), by the metal profile (10, 10*a*), the at least one high-resistance series resistor (13) is arranged electrically insulated on the metal profile (10, 10*a*), and the at least one emission tip (1) is formed from a spring metal and forms an elastic spring element, and a free end of the emission tip (1)

forms a corona tip (2)

that extends freely at a distance from the metal profile (10, 10*a*) which is provided with the insulating potting compound.

2. The emission tip assembly as claimed in claim 1, wherein the emission tip (1) is in the form of a metal spring.

3. The emission tip assembly as claimed in claim 1, wherein the corona tip (2) extends freely at a distance of between 3 mm and 20 mm, above the metal profile (10, 10*a*) which is provided with the insulating potting compound.

4. The emission tip assembly as claimed in claim 1, wherein a high-voltage electrode is operatable in an active or passive manner as at least one of a charging or discharge electrode by AC or DC voltage.

5. The emission tip assembly as claimed in claim 1, wherein an end section (3) of the free end of the emission tip (1) is bent in a direction of a longitudinal axis of a direction of extent of the spring element.

6. The emission tip assembly as claimed in claim 1, wherein a passage (18) is formed in the at least one emission tip (1), said passage is formed in such a way that an auxiliary air quantity (15) is supplied to the corona tip.

7. The emission tip assembly as claimed in claim 1, wherein a passage (18) is formed through the spring element, said passage is connectable to an air channel (8) of the carrier body (7), by which air channel an auxiliary air quantity (15) is supplied to the corona tip (2).

8. The emission tip assembly as claimed in claim 1, wherein the spring element tapers in a direction of the free end of the emission tip (1), and an inner contour of the spring element tapers in the direction of the free end of the emission tip (1).

9. The emission tip assembly as claimed in claim 1, wherein the carrier body (7) is formed from a thermoplastic or thermoset material or a ceramic material.

10. The emission tip assembly as claimed in claim 1, wherein the carrier body (7) is provided with at least one receptacle (17), which is located on a side wall, for arranging the at least one emission tip (1), and the emission tip (1) is inserted into said receptacle.

11. The emission tip assembly as claimed in claim 1, wherein when the emission tip (1) is arranged on the carrier body (7), when said emission tip is inserted into the receptacle (17), a contour of said emission tip is elastically deformable.

12. The emission tip assembly as claimed in claim 11, wherein at least one of the at least one series resistor (13) is mounted on the carrier body (7) in a meandering manner or makes contact with the spring element in a region of the receptacle (17) by a conductive adhesive (16).

13. The emission tip assembly as claimed in claim 1, wherein the series resistor (13) is arranged on the metal profile (10, 10*a*) in an electrically insulated manner using the insulating potting compound.

14. The emission tip assembly as claimed in claim 13, wherein the metal profile (10, 10*a*) is formed from an extrudable material.

15. The emission tip assembly as claimed in claim 13, wherein the metal profile (10, 10*a*) is provided with an insulating layer (11).

16. A high-voltage electrode for charging or discharging substrates, comprising an emission tip assembly (100) as claimed in claim 1, wherein the high-voltage electrode is operated in an active or passive manner as at least one of a charging or discharging electrode with AC or DC voltage.

17. A method for operating an emission tip assembly (100), as claimed in claim 1, comprising the at least one emission tip (1), the method including operating the high-voltage electrode with AC voltage with a peak voltage which is lower than a breakdown voltage for a defined geometry of the corona tip (2) to the metal profile (10, 10*a*).

18. A method for operating an emission tip assembly (100) as claimed in claim 1, comprising providing the at least one emission tip (1) in the form of a spring element, and supplying a passage (18) formed in the at least one emission tip (1) with an auxiliary air quantity (15) to the corona tip (2) through said passage during operation.

* * * * *